US006974188B2

(12) United States Patent
Turner et al.

(10) Patent No.: US 6,974,188 B2
(45) Date of Patent: Dec. 13, 2005

(54) CHAIR WITH PIVOTABLE CHAIR BACK

(75) Inventors: Dennis M. Turner, Mooresville, IN (US); Paul T. Zink, Indianapolis, IN (US); Jason Andrews, Indianapolis, IN (US)

(73) Assignee: Cosco Management, Inc., Wilmington, DE (US)

( * ) Notice: Subject to any disclaimer, the term of this patent is extended or adjusted under 35 U.S.C. 154(b) by 57 days.

(21) Appl. No.: 10/640,229

(22) Filed: Aug. 13, 2003

(65) Prior Publication Data

US 2005/0035636 A1 Feb. 17, 2005

(51) Int. Cl.[7] ..... A47C 3/03

(52) U.S. Cl. ..... 297/270; 297/285; 297/408; 297/301.4

(58) Field of Search ..... 297/270.2, 408, 297/354.1, 354.11, 23, 354.13, 291, 292, 297/293, 289, 285, 463.1, 463.2, 322, 411.38, 297/411.39, 410

(56) References Cited

U.S. PATENT DOCUMENTS

| | | | | | |
|---|---|---|---|---|---|
| 349,907 | A | * | 9/1886 | Morgan | 297/292 |
| 1,150,189 | A | * | 8/1915 | Heater | 297/293 |
| 1,263,161 | A | | 4/1918 | Travers | |
| 1,910,760 | A | | 5/1933 | Garrow | |
| 2,524,624 | A | | 10/1950 | Cramer | |
| 2,662,588 | A | | 12/1953 | Clark | |
| 2,692,012 | A | | 10/1954 | Cramer | |
| 2,703,601 | A | | 3/1955 | Wood | |
| 2,801,678 | A | * | 8/1957 | Brandon | 297/396 |
| 3,186,763 | A | * | 6/1965 | Ferrara | 297/410 |
| 3,215,468 | A | * | 11/1965 | Swenson et al. | 297/284.1 |
| 3,351,378 | A | | 11/1967 | Bliss | |
| 3,365,233 | A | | 1/1968 | Uyeda et al. | |
| 3,402,963 | A | | 9/1968 | Fujioka et al. | |
| 3,603,640 | A | | 9/1971 | Doerner | |
| 3,610,686 | A | | 10/1971 | Caruso | |
| 3,637,256 | A | | 1/1972 | Harty | |
| 3,695,684 | A | | 10/1972 | Barberg | |
| 3,697,130 | A | | 10/1972 | Barecki et al. | |
| 3,758,155 | A | | 9/1973 | Straits | |
| 3,826,453 | A | | 7/1974 | Hitchcock | |
| 3,847,433 | A | | 11/1974 | Acton et al. | |
| 3,989,297 | A | | 11/1976 | Kerstholt | |
| 4,135,836 | A | | 1/1979 | Rensland et al. | |
| 4,157,203 | A | | 6/1979 | Ambasz | |
| 4,316,632 | A | | 2/1982 | Brauning | |
| 4,386,804 | A | | 6/1983 | Ware et al. | |
| 4,400,031 | A | | 8/1983 | DeDecker | |
| 4,400,032 | A | | 8/1983 | dePolo | |
| 4,597,604 | A | | 7/1986 | Singer | |
| 4,600,240 | A | * | 7/1986 | Suman et al. | 297/408 |
| 4,978,171 | A | * | 12/1990 | Tateyama | 297/411.38 |
| 5,308,143 | A | * | 5/1994 | Cheng et al. | 297/292 |
| 5,531,505 | A | * | 7/1996 | Baetz et al. | 297/408 |
| 5,597,209 | A | * | 1/1997 | Bart et al. | 297/411.38 |

(Continued)

OTHER PUBLICATIONS

Artland® product information (5 pages) (before Aug. 2003).

(Continued)

*Primary Examiner*—Peter M. Cuomo
*Assistant Examiner*—Erika Garrett
(74) *Attorney, Agent, or Firm*—Barnes & Thornburg LLP

(57) ABSTRACT

A chair comprises a frame, a chair back, and a chair back return device. The chair back is mounted to the frame for pivotable movement away from a home position. The chair back return device is arranged to return the chair back to the home position.

15 Claims, 6 Drawing Sheets

U.S. PATENT DOCUMENTS 5,669,668 A * 9/1997 Leuchtmann ..... 297/408
5,683,142 A 11/1997 Gunderson et al.
5,803,546 A * 9/1998 Yamazaki ..... 297/333
5,882,069 A * 3/1999 Gunnett et al. ..... 297/125
5,906,414 A * 5/1999 Rus ..... 297/408
RE36,335 E * 10/1999 Perry ..... 297/448.2
6,050,645 A * 4/2000 Bradbury ..... 297/411.38
6,079,776 A * 6/2000 Breitner et al. ..... 297/216.12
6,095,611 A 8/2000 Bar et al.
6,250,716 B1 * 6/2001 Clough ..... 297/408
6,257,665 B1 7/2001 Nagamitsu et al.
6,257,668 B1 * 7/2001 Chou et al. ..... 297/411.32
6,305,747 B1 10/2001 Mei
6,478,379 B1 * 11/2002 Ambasz ..... 297/354.11
6,481,789 B1 * 11/2002 Ambasz ..... 297/55
6,482,798 B2 * 11/2002 Schroder et al. ..... 514/12
6,530,622 B1 * 3/2003 Ekern et al. ..... 297/284.4
6,612,653 B2 * 9/2003 Takata ..... 297/408
6,655,731 B2 * 12/2003 Martin ..... 297/23

OTHER PUBLICATIONS

Gauss Seating Corporation product information (4 pages) (before Aug. 2003).

* cited by examiner

CHAIR WITH PIVOTABLE CHAIR BACK

BACKGROUND

The present disclosure relates to chairs. More particularly, the present disclosure relates to chairs with chair backs that are able to pivot.

Chairs typically have chair backs. A chair back is used to support the back of a person sitting on the chair.

SUMMARY

According to the present disclosure, a chair is provided. The chair comprises a frame and a chair back. The chair back is mounted to the frame for pivotable movement about a pivot axis in opposite directions from a home position. A chair back return device is used to return the chair back to the home position.

The frame includes left and right chair back mounts. A left side of the chair is mounted to the left chair back mount. A right side of the chair is mounted to the right chair back mount.

The chair back return device includes a left return spring and a right return spring. The left return spring is mounted to the left chair back mount to engage a left tab included in the left side of the chair back. The right return spring is mounted to the right chair back mount to engage a right tab included in the right side of the chair back. The left and right return springs act against the left and right tabs to pivot the chair back to return the chair back to the home position.

Additional features and advantages of the apparatus will become apparent to those skilled in the art upon consideration of the following detailed description exemplifying the best mode of the disclosure as presently perceived.

BRIEF DESCRIPTION OF THE DRAWINGS

The detailed description particularly refers to the accompanying figures in which.

DETAILED DESCRIPTION

Figure 1:
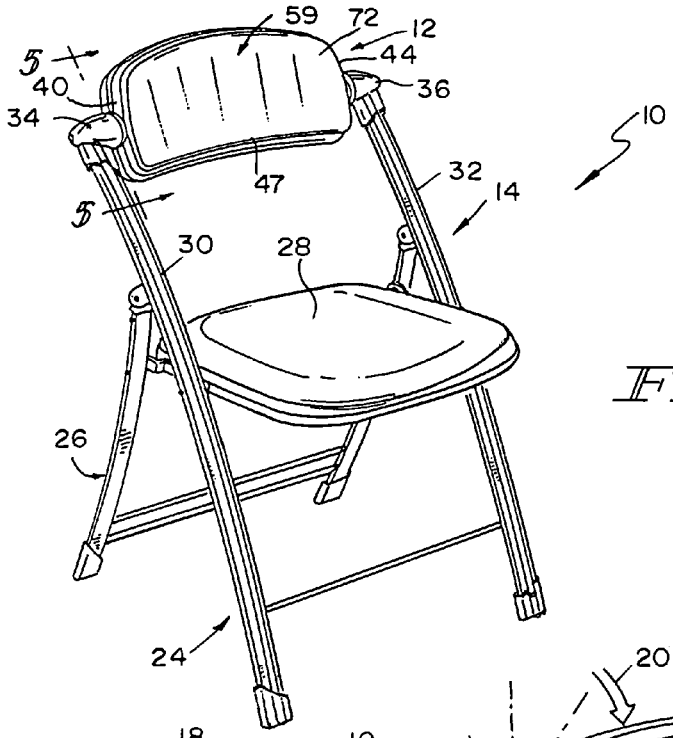
FIGS. 1–3 are perspective views showing a chair including a chair back coupled to left and right chair back mounts included in a frame of the chair for pivotable movement of the chair back about a pivot axis between a home position shown in FIG. 1 and a rearward-leaning pivot position shown in FIG. 2 and a forward-leaning pivot position shown in FIG. 3.

A chair 10 is shown in FIG. 1. The chair 10 includes a chair back 12 mounted to a frame 14 for pivotable movement relative thereto about a pivot axis 16. The chair back 12 is pivotable from a home position shown in FIGS. 1 and 5 in a rearward direction 18 to a rearward-leaning pivot position shown in FIGS. 2 and 6 when, for example, a person sitting on the chair 10 leans rearward or backward. The chair back 12 is also pivotable from the home position in an opposite, forward direction 20 to a forward-leaning pivot position shown in FIGS. 3 and 7 when, for example, a person sitting on the chair 10 leans forward.

Figure 4:
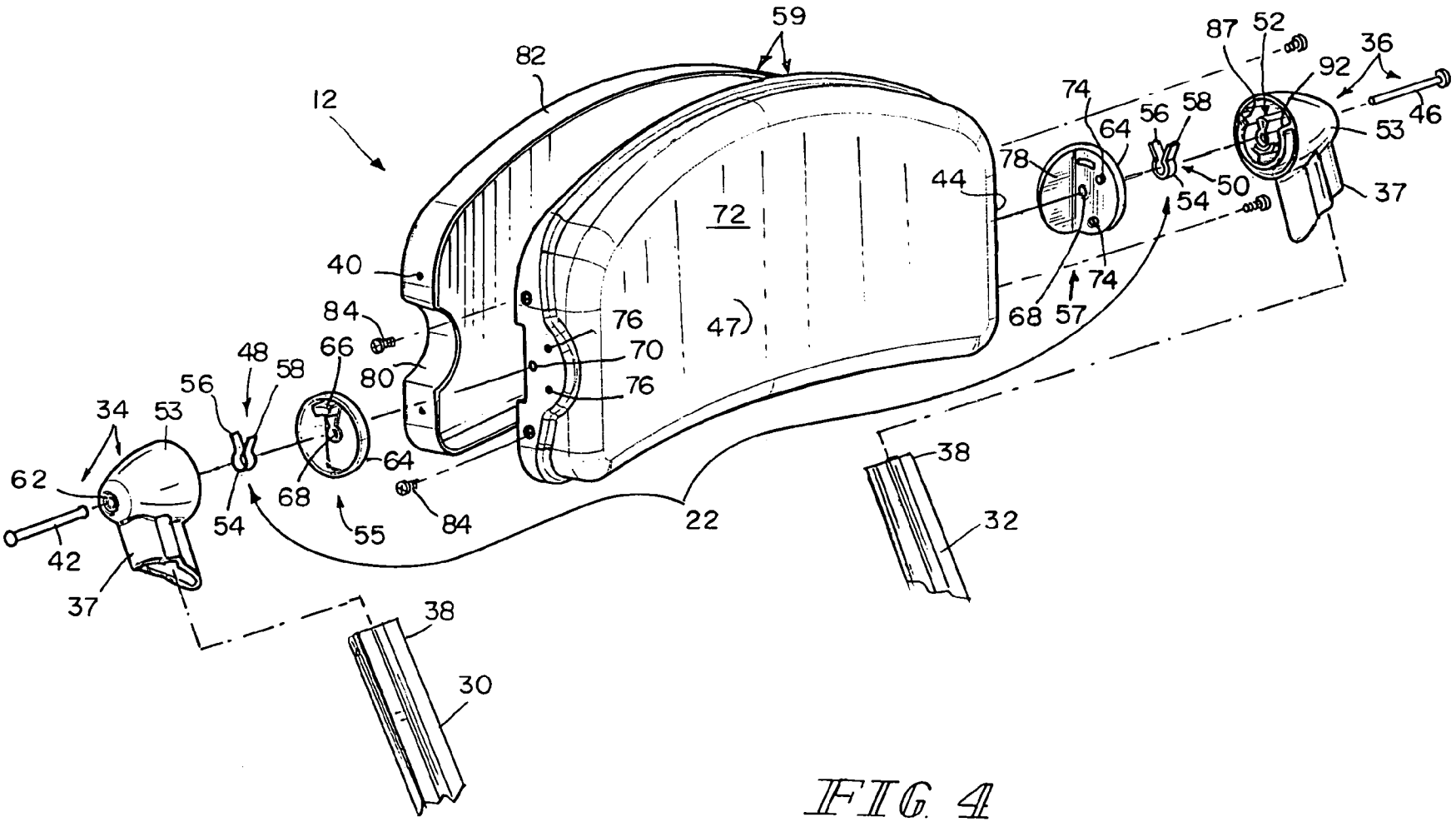
FIG. 4 is an exploded perspective view showing components of the chair back in the middle of the page, components of the left and right chair back mounts on the left and rights sides of the page, and somewhat U-shaped left and right return springs between the chair back and the left and right chair back mounts for returning the chair back to the home position from the rearward-leaning and forward-leaning pivot positions.

The chair 10 includes a chair-back return device 22, as shown in FIG. 4. The chair-back return device 22 is arranged to return the chair back 12 to the home position from the rearward-leaning and forward-leaning pivot positions, as discussed in more detail herein.

Figure 2:
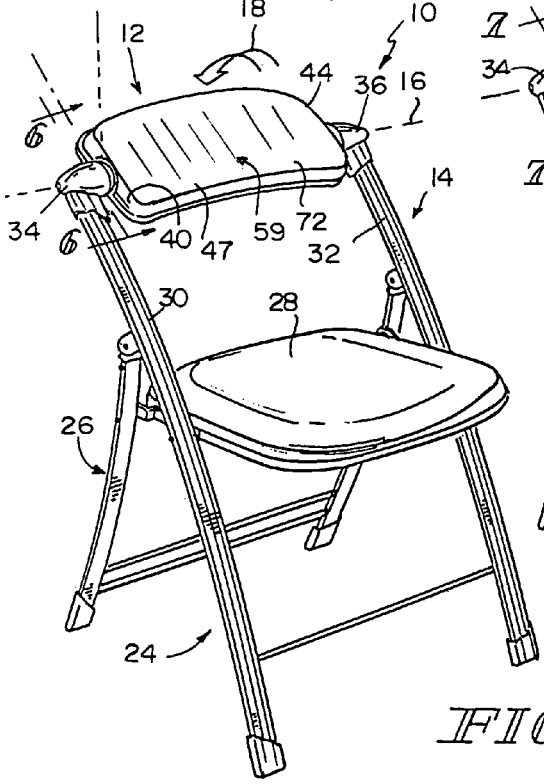
Figure 3:
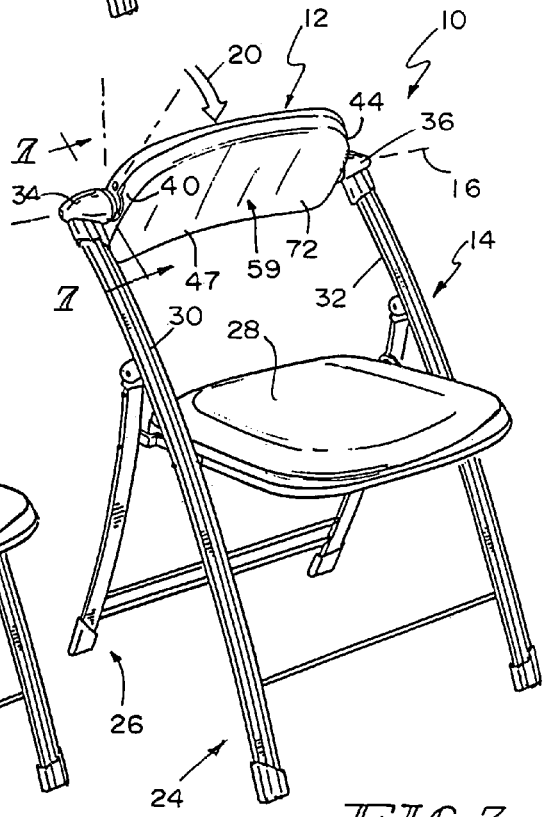

The frame 14 includes a front leg unit 24 and a rear leg unit 26, as shown in FIGS. 1–3. The front and rear leg units 24, 26 are coupled to one another for pivotable movement between an unfolded position (shown in FIGS. 1–3) for use of the chair 10 and a folded position (not shown) for storage of the chair 10. A seat 28 is mounted to the frame 14 for pivotable movement as the front and rear leg units 24, 26 are pivoted between the unfolded and folded positions.

The front leg unit 24 includes left and right frame members 30, 32 and left and right chair back mounts 34, 36, as shown in FIGS. 1–4 and 8. In the illustrated embodiment, the frame members 30, 32 are legs. A leg receiver 37 of the left chair back mount 34 is mounted to a top portion 38 of the left frame member 30. A leg receiver 37 of the right chair back mount 36 is mounted to a top portion 38 of the right frame member 32.

The chair back 12 is positioned between and mounted to the left and right chair back mounts 34, 36 for pivotable movement about the pivot axis 16 in the rearward and forward directions 18, 20, as shown in FIGS. 1–3 and 8. A left side 40 of the chair back 12 is mounted to a left axle 42 of the left chair back mount 34. A right side 44 of the chair back 12 is mounted to a right axle 46 of the right chair back mount 36. The left and right axles 42, 46 cooperate to define the pivot axis 16. Front and rear sides 47, 49 of the chair back 12 extend between the left and right sides 40, 44. Chair back 12, left axle 42, and right axle 46 cooperate to define a pivotable back unit.

The chair-back return device 22 is arranged to engage at least one of the left and right sides 40, 44 of the chair back 12 to pivot the chair back 12 to return the chair back 12 to the home position from the rearward-leaning and forward-leaning pivot positions. Stated otherwise, the chair-back return device 22 provides return means for engaging at least one of the left and right sides 40, 44 of the chair back 12 to pivot the chair back 12 to return the chair back 12 to the home position from the rearward-leaning and forward-leaning pivot positions.

The chair-back return device 22 includes a left return spring 48 and a right return spring 50, as shown in FIG. 4.

Figure 5:
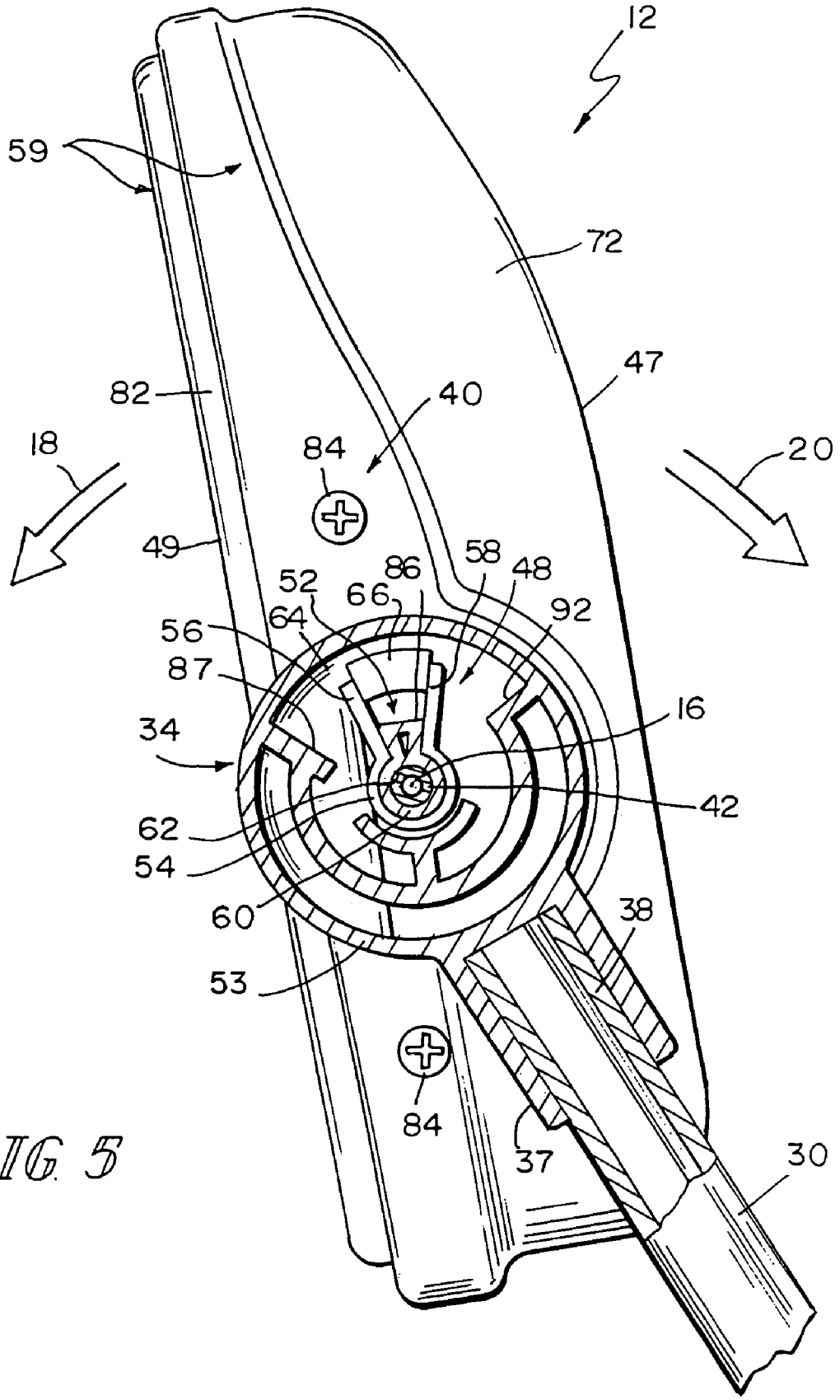
FIG. 5 is a sectional view taken along lines 5—5 of FIG. 1 showing the chair back in its home position and showing a tab that is included in the left side of the chair back and positioned between and in engagement with rear (on the left) and front (on the right) spring arms of the left return spring.
Figure 6:
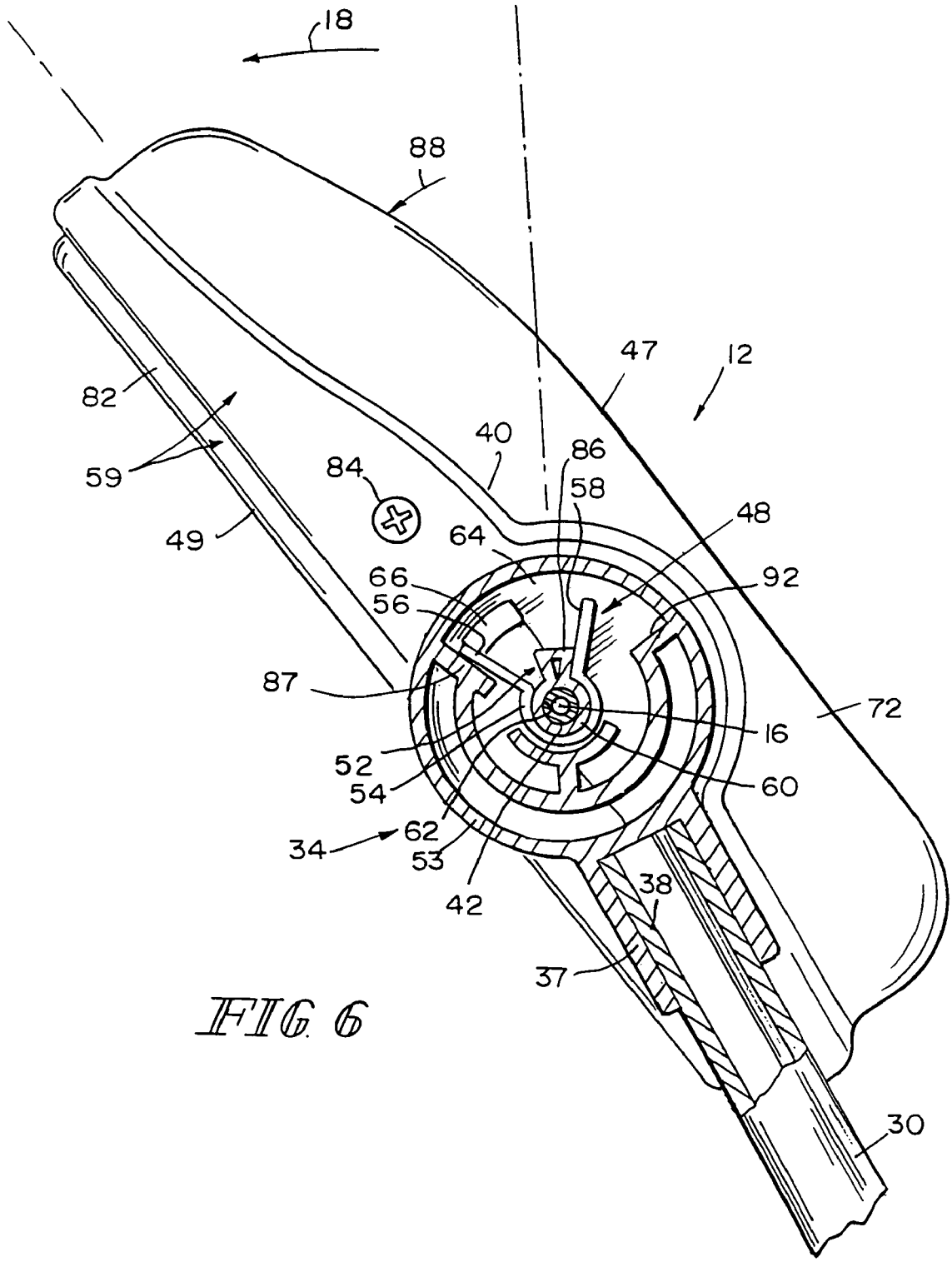
FIG. 6 is a sectional view taken along lines 6—6 of FIG. 2 showing the chair back pivoted in a rearward direction to its rearward-leaning pivot position and showing engagement between the rear spring arm of the left return spring and a rear pivot limiter to limit pivotable movement of the chair back in the rearward direction.
Figure 7:
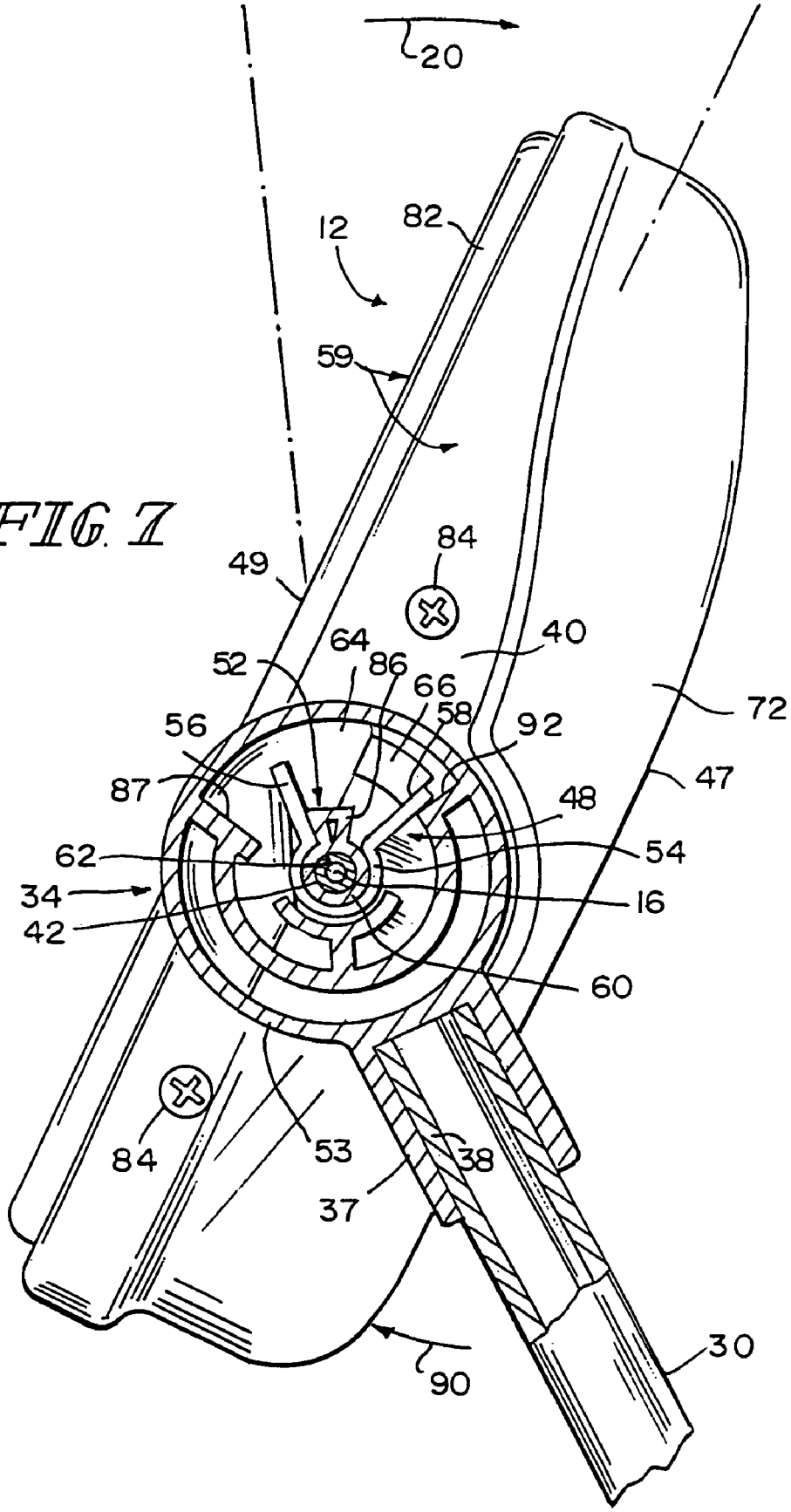
FIG. 7 is a sectional view taken along lines 7—7 of FIG. 3 showing the chair back pivoted in a forward direction to its forward-leaning pivot position and showing engagement between the front spring arm of the left return device and a front pivot limiter to limit pivotable movement of the chair back in the forward direction.

The left return spring 48 is mounted to a spring mount 52 included in the left chair back mount 34 and is arranged to engage a left motion transmitter 55 included in the left side 40 of the chair back 12, as shown in FIGS. 5–7. The right return spring 50 is mounted to a spring mount 52 included in the right chair back mount 36 and is arranged to engage a right motion transmitter 57 included in the right side 44. Each spring mount 52 is mounted to a generally cone-shaped shroud 53 which surrounds the spring mount 52 and the return spring 48, 50 mounted thereto. The motion transmitters 55, 57 are arranged to transmit motion between the return springs 48, 50 and a back rest 59 included in the chair back 12, as discussed in more detail herein.

Each return spring 48, 50 includes a base 54 and relatively movable rear and front flanges or spring arms 56, 58, as shown in FIG. 4 with respect to both return springs 48, 50 and shown in FIGS. 5–7 with respect to return spring 48. The base 54 is mounted to an annular base mount 60 included in a spring mount 52. Each base mount 60 is formed to include an axle channel 64 through which one of the axles 42, 46 extends. In the illustrated embodiment, the base 54 is C-shaped and fits over the base mount 60. The first and second flanges or spring arms 56, 58 extend radially outwardly from base 54 and are circumferentially spaced from one another.

Each motion transmitter 55, 57 includes a disk-shaped tab mount 64 and a tab 66 mounted thereto for engagement with a spring 48, 50, as shown in FIG. 4. Each tab mount 64 is formed to include an axle-receiving opening 68. The left axle 42 extends through the axle-receiving opening 68 formed in the tab mount 64 of the left motion transmitter 55 into an axle-receiving opening 70 formed in a front shell member 72 of the back rest 59. The right axle 46 extends through the axle-receiving opening 68 formed in the tab mount 64 of the right motion transmitter 57 into an axle-receiving opening 70 formed in the front shell member 72.

A pair of transmitter retainers 74 shown in FIG. 4 are mounted to an axially inner side of each tab mount 64. The retainers 74 extend into corresponding retainer receivers 76 formed in the front shell member 74 so that the motion transmitters 55, 57 and the back rest 59 pivot with one another.

Figure 8:
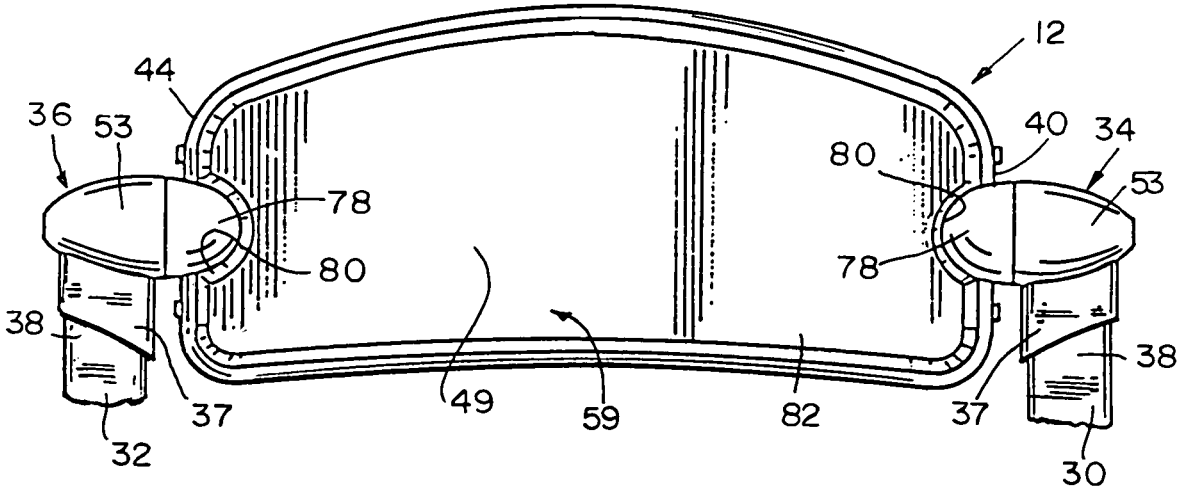
FIG. 8 is a rear elevational view, with portions broken away, showing the chair back mounted on the left and right chair back mounts.

An aesthetic portion 78 shown in FIG. 8 is mounted to the axially inner side of each tab mount 64. Each aesthetic portion 78 extends into a recess 80 formed in a rear shell member 82 included in the back rest 59. The front and rear shell members 72, 82 are coupled to one another by fasteners 84 shown in FIGS. 4–7 to provide the back rest 59.

Interaction between the left return spring 48 and the tab 66 of the left motion transmitter 55 is shown in FIGS. 5–7. The following discussion of such interaction applies also the right return spring 50 and tab 66 of the right motion transmitter 57.

The tab 66 extends between the rear and front flanges 56, 58. The tab 66 is positioned radially outwardly from a flange or arm stop 86 that is included in the spring mount 52 and extends radially outwardly from the flange mount base 60. In the home position of the chair back 12, the tab 66 engages both flanges or spring arms 56, 58 and both flanges or spring arms 56, 58 engage the flange or arm stop 86, as shown in FIG. 5.

The tab 66 engages the rear flange or spring arm 56 and disengages the front flange or spring arm 58 when the chair back 12 is pivoted in the rearward direction 18 to the rearward-leaning pivot position by a rearward pivot force 88, as shown in FIG. 6. The tab 66 pivots the rear flange or spring arm 56 in the rearward direction 18 away from the front flange or spring arm 58 which remains engaged with the flange or arm stop 86, thereby rearwardly loading the return spring 48.

A rear pivot limiter 87 is arranged to limit pivotable movement of the chair back 12 in the rearward direction 18, as shown in FIG. 6. The rear spring arm 56 extends between the rear pivot limiter 87 and the tab 66 so that the rear pivot limiter 87 engages the rear spring arm 56 to limit such rearward pivotable movement. In the illustrated embodiment, the rear pivot limiter 87 is a wall mounted to and extending radially inwardly from the shroud 53.

The rearwardly loaded return spring 48 returns the chair back 12 to the home position when the rearward pivot force 88 is removed from the chair back 12. The rear flange or spring arm 56 engages the tab 66 and moves toward the front flange or spring arm 58 to apply a force thereto to pivot the chair back 12 in the forward direction 20 to return the chair back 12 to the home position from the rearward-leaning pivot position. The rear flange or spring arm 56 re-engages the flange stop 86 upon return of the chair back 12 to the home position.

The tab 66 engages the front flange or spring arm 58 and disengages the rear flange or spring arm 56 when the chair back 12 is pivoted in the forward direction 20 to the forward-leaning pivot position by a forward pivot force 90, as shown in FIG. 7. The tab 66 pivots the front flange or spring arm 58 in the forward direction 20 away from the rear flange or spring arm 56 which remains engaged with the flange or arm stop 86, thereby forwardly loading the return spring 48.

A front pivot limiter 92 is arranged to limit pivotable movement of the chair back 12 in the forward direction 20, as shown in FIG. 7. The front flange or spring arm 58 extends between the front pivot limiter 92 and the tab 66 so that the front pivot limiter 92 engages the front flange or spring arm 58 to limit such forward pivotable movement. In the illustrated embodiment, the front pivot limiter 92 is a wall mounted to and extending radially inwardly from the shroud 53. The rear and front pivot limiters 87 and 92 are spaced circumferentially from one another.

The forwardly loaded return spring 48 returns the chair back 12 to the home position when the forward pivot force 90 is removed from the chair back 12. The front flange or spring arm 58 engages the tab 66 and moves toward the rear flange or spring arm 56 to apply a force thereto to pivot the chair back 12 in the rearward direction 18 to return the chair back 12 to the home position from the forwardly-leaning pivot position. The front flange or spring arm 58 re-engages the flange stop 86 upon return of the chair back 12 to the home position.

A set of rear and front pivot limiters 87, 92 are also mounted to the shroud 53 of the right chair back mount 36, as shown in FIG. 4. They operate in the same manner with respect to the right return spring 50 as described in connection with the rear and front pivot limiters 87, 92 associated with the left return spring 48.

The rear pivot limiters 87 and the front pivot limiters 92 cooperate to define a pivot limiter device arranged to limit pivotable movement of the chair back 12 away from the home position in the rearward and forward directions 18, 20. The pivot limiter device thus provides means for limiting pivotable movement of the chair back 12 away from the home position in the rearward and forward directions 18, 20.

What is claimed is:

1. A chair comprising a frame including a left chair-back support and a right chair-back support arranged to lie in spaced-apart relation to the left chair-back support, a pivotable back unit including a chair back arranged to lie between the left and right chair-back supports, a left axle coupled to a left side of the chair back, and a right axle coupled to a right side of the chair back, the left axle being coupled to the left chair-back support and the right axle being coupled to the right chair-back support to support the chair back for pivotable movement relative to the frame about a horizontal pivot axis from a home position in a counterclockwise direction to assume a rearward-leaning pivot position and in a clockwise direction to assume a forward-leaning pivot position, and a chair-back return device including a left return spring mounted on the left chair-back support and formed to include first and second spring arms arranged to lie in spaced-apart relation to one another to define a tab-receiving space therebetween, the chair-back return device further including a tab mounted in fixed relation to the chair back and arranged to extend into the tab-receiving space formed between the first and second spring arms and arranged to move the first spring arm relative to the frame to load the left return spring in response to movement of the chair back about the horizontal pivot axis under an external first pivoting force applied to the chair back from the home position toward the rearward-leaning position to provide first spring arm return means for returning the chair back to the home position once the first pivoting force is no longer applied to the chair back and to move the second spring arm relative to the frame to load the left return spring in response to movement of the chair back about the horizontal pivot axis under an external second pivoting force applied to the chair back from the home position toward the forward-leaning position to provide second spring arm return means for returning the chair back to the home position once the second pivoting force is no longer applied to the chair back.

2. The chair of claim 1, further comprising a right return spring mounted on the right chair-back support and formed to include third and fourth spring arms arranged to lie in spaced-apart relation to one another to define a tab-receiving space therebetween, the chair-back return device further including an auxiliary tab mounted in fixed relation to the chair back and arranged to extend into the tab-receiving space formed between the third and fourth spring arms and arranged to move the third spring arm relative to the frame to load the right return spring in response to movement o the chair back about the horizontal pivot axis under the external first pivoting force from the home position toward the rearward-leaning position to provide third spring arm return means for returning the chair back to the home position once the external first pivoting force is no longer applied to the chair back and to move the fourth spring arm relative to the frame to load the right return spring in response to movement of the chair back about the horizontal pivot axis under the external second pivoting force from the home position toward the forward-leaning position to provide fourth spring arm return means for returning the chair back to the home position once the external second pivoting force is no longer applied to the chair back.

3. The chair of claim 1, wherein the left chair-back support includes a shroud formed to include an interior region and a spring mount located in the interior region of the shroud and the left return spring is coupled to the spring mount and arranged to lie in the interior region of the shroud.

4. The chair of claim 3, wherein the left chair-back support further includes a left frame member arranged to extend upwardly relative to a seat included in the chair and a leg receiver coupled to the left frame member and to the shroud to support the shroud above the left fame member and to present the left return spring located in the interior region of the shroud toward the chair back to locate the tab of the chair-back return device in the tab-receiving space defined between the first and second spring arms.

5. The chair of claim 3, wherein the spring mount includes a base mount formed to include an axle channel receiving the left axle therein and the left return spring includes a base arranged to interconnect the first and second spring arms and coupled to the base mount.

6. The chair of claim 5, wherein the spring mount further includes an arm stop coupled to the base mount and arranged to lie between the first and second spring arms in a location between the base mount and the tab to engage both of the first and second spring arms upon movement of the chair back to assume the home position.

7. The chair of claim 3, wherein the left chair-back support further includes forward and rearward pivot limiters located in the interior region of the shroud and arranged to lie in circumferentially spaced-apart relation to one another to locate a portion of the first spring arm between the rear pivot limiter and the tab and a portion of the second spring arm between the tab and the forward pivot limiter, the rearward pivot limiter is arranged to engage the first spring arm during movement of the chair back about the horizontal pivot axis from the home position toward the rearward-leaning position to establish the rearward-leaning position, and the forward pivot limiter is arranged to engage the second spring arm during movement of the chair back about the horizontal pivot axis from the home position toward the forward-leaning position to establish the forward-leaning position.

8. The chair of claim 1, wherein the left chair-back support includes a spring mount including a base mount and the spring includes a base arranged to interconnect the first and second spring arms and coupled to the base mount.

9. The chair of claim 8, wherein the base mount has a round exterior surface and the base is C-shaped and arranged to engage the round exterior surface of the base mount.

10. The chair of claim 8, wherein the spring is a monolithic element made of a strip of spring material.

11. The chair of claim 8, wherein the spring mount further includes an arm stop coupled to the base mount and arranged to lie between the first and second spring arms in a location between the base mount and the tab to engage both of the first and second spring arms upon movement of the chair back to assume the home position.

12. The chair of claim 1, wherein the left chair-back support further includes forward and rearward pivot limiters arranged to lie in circumferentially spaced-apart relation to one another to locate a portion of the first spring arm between the rear pivot limiter and the tab and a portion of the second spring arm between the tab and the forward pivot limiter, the rearward pivot limiter is arranged to engage the first spring arm during movement of the chair back about the horizontal pivot axis from the home position toward the rearward-leaning position to establish the rearward-leaning position, and the forward pivot limiter is arranged to engage the second spring arm during movement of the chair back about the horizontal pivot axis from the home position toward the forward-leaning position to establish the forward-leaning position.

13. The chair of claim 1, wherein the backrest further includes a left motion transmitter coupled to a left side of the chair back and arranged to support the tab in the tab-receiving space defined between the first and second spring arms.

14. The chair of claim 13, wherein the left motion transmitter includes a disk-shaped tab mount coupled to the tab and formed to include an axle-receiving opening and the left axle extends through the axle-receiving opening.

15. The chair of claim 14, wherein the chair back includes a rear shell member formed to include a recess and a front shell member coupled to the rear shell member, the left motion transmitter further includes an aesthetic portion mounted to an axially inner side of the disk-shaped tab mount and arranged to extend into the recess formed in the rear shell member.

* * * * *